US012352500B2

(12) United States Patent
Kent et al.

(10) Patent No.: US 12,352,500 B2
(45) Date of Patent: Jul. 8, 2025

(54) MULTIPLE TUBE HEAT EXCHANGER

(71) Applicant: MAHLE INTERNATIONAL GMBH, Stuttgart (DE)

(72) Inventors: Scott Kent, Albion, NY (US); Robert Louis Runk, Lockport, NY (US)

(73) Assignee: MAHLE International GmbH, Stuttgart (DE)

( * ) Notice: Subject to any disclaimer, the term of this patent is extended or adjusted under 35 U.S.C. 154(b) by 242 days.

(21) Appl. No.: 18/209,221

(22) Filed: Jun. 13, 2023

(65) Prior Publication Data

US 2024/0418450 A1 Dec. 19, 2024

(51) Int. Cl.
*F28D 1/04* (2006.01)
*F28F 1/02* (2006.01)

(52) U.S. Cl.
CPC ..... *F28D 1/0426* (2013.01); *F28F 1/025* (2013.01)

(58) Field of Classification Search
CPC ..... F28D 1/0426; F28F 1/025
See application file for complete search history.

(56) References Cited

U.S. PATENT DOCUMENTS

| | | | |
|---|---|---|---|
| 9,752,803 | B2 | 9/2017 | Matter, III et al. |
| 2006/0243432 | A1 | 11/2006 | Demuth et al. |
| 2009/0027671 | A1 | 1/2009 | Jarrell |
| 2020/0191501 | A1* | 6/2020 | Pelletier ..... F28F 1/14 |
| 2022/0221226 | A1 | 7/2022 | Runk et al. |
| 2022/0243989 | A1 | 8/2022 | Zhong et al. |

FOREIGN PATENT DOCUMENTS

| | | |
|---|---|---|
| CN | 103644685 | 3/2014 |
| CN | 109595951 | 4/2019 |
| DE | 102012003526 | 8/2013 |
| EP | 1762808 | 3/2007 |
| EP | 1856500 | 11/2007 |
| FR | 2899959 | 10/2007 |
| WO | 200/4074756 | 10/2004 |
| WO | 2006/083511 | 8/2006 |
| WO | 2012/112802 | 8/2012 |
| WO | 2020/259671 | 12/2020 |
| WO | 2021/250738 | 12/2021 |

* cited by examiner

*Primary Examiner* — Eric S Ruppert
(74) *Attorney, Agent, or Firm* — Barnes & Thornburg LLP

(57) ABSTRACT

A heat exchanger is provided. The heat exchanger includes a plurality of manifolds and first and second pluralities of tubes that extend between different pairs of the plurality of manifolds. The heat exchange tubes each include a heat exchange portion extending along a straight direction, an outlet portion extending a transverse axis and a transition portion that connects the heat exchange portion to the outlet portion, wherein the transition portion transitions simultaneously in the transverse direction and along an offset axis, wherein the changing direction has vector components along both the transverse axis and the offset axis along the length of the transition portion. Wherein an end of the heat exchange as a jog region that comprises a bend along the offset axis.

13 Claims, 7 Drawing Sheets

MULTIPLE TUBE HEAT EXCHANGER

BACKGROUND OF THE INVENTION

This application relates to heat exchangers with flat tubes that can allow for multiple passes of refrigerant or other fluid therethrough.

In heat pump applications and heat exchangers having exclusively one single passage it is a problem that under unfavorable environment conditions the single passage may freeze up easily. This problem could be solved in that, for example, a refrigerant pressure drop in a heat exchanger block having flat tubes is increased, e.g. by an increased deflection of the refrigerant in the heat exchanger block. An increase of the pressure drop goes hand in hand with increasing a boiling temperature of the refrigerant as a result of which the temperature of the flat tubes or of the heat exchanger block can be increased and thus the risk of a freezing can be at least reduced. This can be achieved for example by a meander-like or multi-loop flow through the heat exchanger.

From CN 103 644 685 A, a heat exchanger having two inflow collectors and two outflow collectors is known. This heat exchanger has two types of flat tubes stacked upon one another alternatingly. The flat tubes of a second type are substantially straight. The flat tubes of first type have a sharp bend or fold near their longitudinal ends, in which bend or fold a central heat exchange portion of the respective flat tubes merges into an angled portion of these flat tubes. Accordingly, a first of the inflow and a first of the outflow collectors are arranged in line with flat tubes of the second type and a second of the inflow and a second of the outflow collectors are each arranged aside of the flat tubes of the second type and connected to the angled portions of the flat tubes of the first type.

However, the sharp bend or fold near the longitudinal ends of the flat tubes (of the first type) leads to increased internal mechanical stresses in the area of the sharp bend or fold. Thus, such usual flat tubes may be prone to material failure either during their manufacturing or whilst operation of the heat exchanger due to the coolant or refrigerant pressure they have to withstand when the heat exchanger is operated.

SUMMARY OF THE INVENTION

A first representative embodiment of the disclosure is provided. The embodiment includes a heat exchanger. The heat exchanger includes a first manifold, a second manifold, a third manifold, and a fourth manifold. A plurality of first tubes each with a first end are connected to the first manifold and a second end connected to the third manifold, each of the first tubes comprising a straight heat exchange portion and a curved transition portion. A plurality of second tubes each with a first end are connected to the second manifold and a second end connected to the fourth manifold, each of the first tubes comprising a straight heat exchange portion and a curved transition portion. The plurality of first tubes all arranged in the same orientation and in parallel with each other and with a space between the straight heat exchange portions of adjacent first tubes. The plurality of second tubes all arranged in the same orientation and in parallel with each other, each of the plurality of second tubes positioned within one of the spaces between adjacent first tubes with a possible exception of an one or more outermost second tubes of the plurality of second tubes. The first and fourth manifolds are arranged proximate to each other and the second and third manifolds are arranged proximate to each other and further from the first and fourth manifolds. Each of the plurality of first and second tubes further comprise an outer top surface and an outer bottom surface arranged opposite one another at a thickness of the tube body and having two outer side surfaces arranged opposite one another at a width of the tube body, the outer side surfaces connecting the outer top to the outer bottom surface, the tube body has a heat exchange portion extending along a straight extension direction such that flow through the at least one coolant channel flows in the extension direction when flowing through the heat exchange portion. The tube body has an outlet portion extending along a transverse axis that is perpendicular with respect to the extension axis, such that flow through the at least one coolant channel flows in a transverse direction along the transverse axis when flowing through the heat exchange portion. The tube body has a transition portion connecting the heat exchange portion to the outlet portion, wherein the transition portion transitions simultaneously in the transverse direction and along an offset axis, wherein the offset axis is perpendicular to each of the extension direction and the transverse direction, wherein the transition portion is formed such that flow through the at least one coolant channel within the transition portion flows in a changing direction along a length of at least part of the transition portion, wherein the changing direction has vector components along both the transverse axis and the offset axis along the length of the transition portion. The outlet portion is arranged at a distance from the heat exchange portion measured in the parallel to the offset axis. An end of the heat exchange has jog region that comprises a bend along the offset axis and on an opposite side of the heat exchange portion of the tube body than the outlet portion, wherein flow through the at least one coolant channel in the jog region has vector components along both the extension axis and the offset axis, the jog region portion joins with the transition portion.

Another representative embodiment of the disclosure is provided. The embodiment includes a heat exchange tube for a heat exchanger. The tube includes a tube body delimiting at least one coolant channel for a coolant or a refrigerant. The tube body having an outer top surface and an outer bottom surface arranged opposite one another at a thickness of the tube body and having two outer side surfaces arranged opposite one another at a width of the tube body, the outer side surfaces connecting the outer top to the outer bottom surface. The tube body has a heat exchange portion extending along a straight extension direction such that flow through the at least one coolant channel flows in the extension direction when flowing through the heat exchange portion. The tube body has an outlet portion extending along a transverse axis that is perpendicular with respect to the extension axis, such that flow through the at least one coolant channel flows in a transverse direction along the transverse axis when flowing through the heat exchange portion. The tube body has a transition portion connecting the heat exchange portion to the outlet portion, wherein the transition portion transitions simultaneously in the transverse direction and along an offset axis, wherein the offset axis is perpendicular to each of the extension direction and the transverse direction, wherein the transition portion is formed such that flow through the at least one coolant channel within the transition portion flows in a changing direction along a length of at least part of the transition portion, wherein the changing direction has vector components along both the transverse axis and the offset axis along the length of the transition portion. The outlet portion is arranged at a distance from the heat exchange portion measured in the parallel to the offset axis. An end of the heat exchange has jog region that comprises a bend along the offset axis and on an opposite side of the heat exchange portion of the tube body than the outlet portion, wherein flow through the at least one coolant channel in the jog region has vector components along both the extension axis and the offset axis. The jog region portion joins with the transition portion.

Advantages of the present disclosure will become more apparent to those skilled in the art from the following description of the preferred embodiments of the disclosure that have been shown and described by way of illustration. As will be realized, the disclosed subject matter is capable of other and different embodiments, and its details are capable of modification in various respects. Accordingly, the drawings and description are to be regarded as illustrative in nature and not as restrictive.

BRIEF DESCRIPTION OF DRAWINGS

FIG. 5 depicts tubes 60 and 80 with slightly different dimensions and opposite geometry, i.e. with respect to the direction of portions 61*z*, 81*z* if both tubes were to be arranged with the sections 61*w*, 81*w* pointing in the same direction. One of ordinary skill in the art will understand that in some embodiments tubes 60 and 80 may be formed with the same dimensions and an opposite geometry, while in other embodiments tubes 60 and 80 may be formed with slightly different dimensions and an opposite geometry.

DETAILED DESCRIPTION OF THE INVENTION

Figure 7:
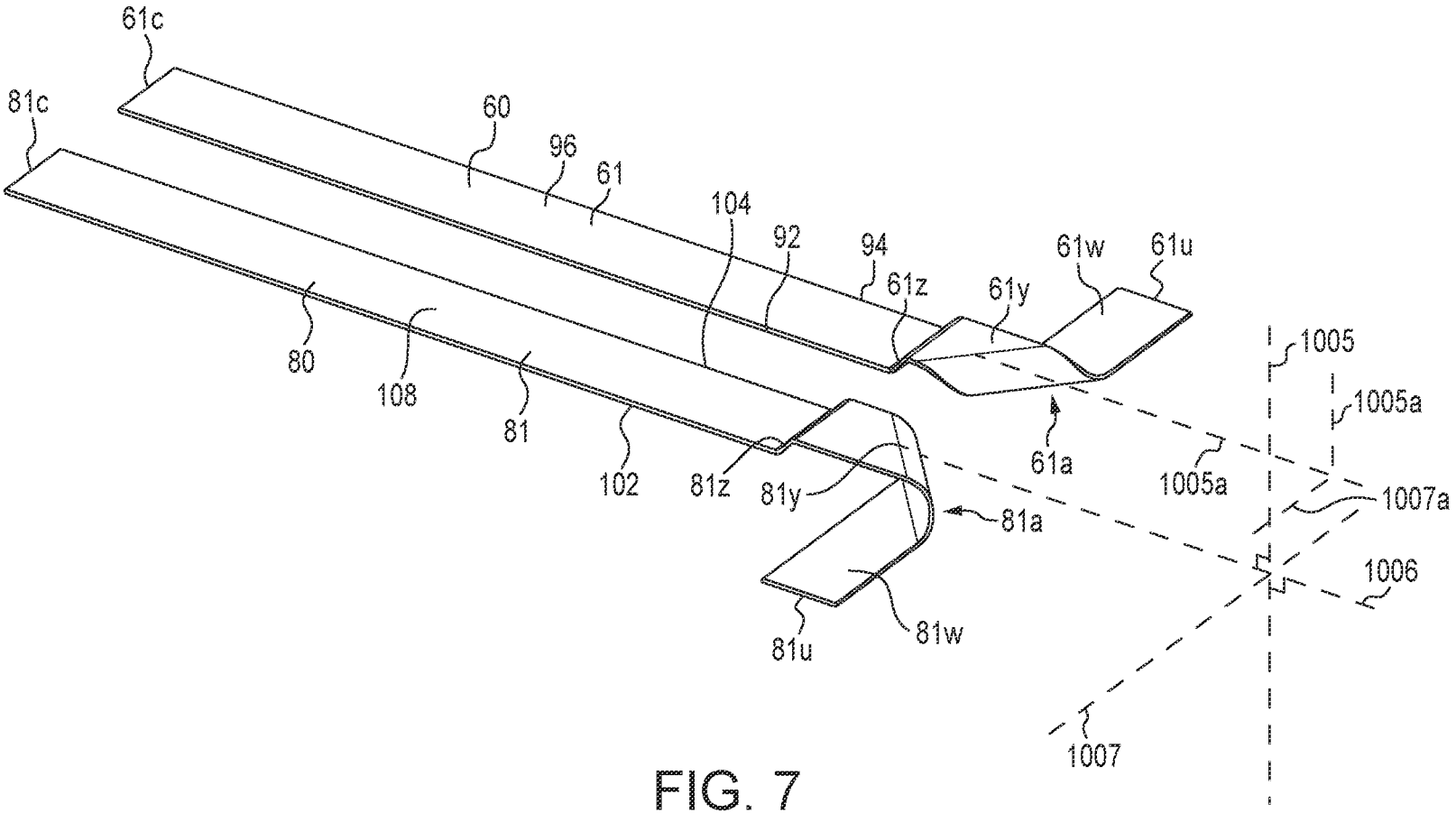
FIG. 7 is another perspective view of the first and second tubes with a right side of the first tube facing upward on the page and the left side portion of the second tube facing upward on the page.

Turning now to FIGS. 7, a multiple tube heat exchanger 10 is provided that can be used within an overall heat exchange system 10. The heat exchanger 10 is usable in various heating and cooling scenarios. For example, the heat exchange system 10 is configured to be operable in two different configurations, a first where a heat exchanger 10 in an indoor environment provides cooling to the indoor environment (either by cooling a fluid that flows through the heat exchanger, or by cooling a space within the indoor environment) and a second where the heat exchanger 10 in the indoor environment provides heat to the indoor environment (either by heating a fluid that flows through the heat exchanger, or by heating a space within the indoor environment. The system 10 therefore operates with the indoor heat exchanger operating as an evaporator when it is to provide cooling and a condenser when it is to provide heating.

The heat exchanger 10 includes a plurality of first tubes 60 and a plurality of second tubes 80. The plurality of first tubes 60 and the plurality of second tubes 80 are fluidly disposed such that, in some embodiments, as refrigerant fluid flows through the system 10, the refrigerant flows through each of the plurality of first tubes 60 and the plurality of second tubes 80 before flowing through a second heat exchanger or before flowing past the components that are desired to be thermally modified (i.e. heated or cooled) by the refrigerant. In some embodiments, the heat exchanger 10 can be used within a heat exchange system 10 that has two operational modes (i.e. either to supply heat to the heat exchanger or to remove heat from a heat exchanger) the path of flow through the first and second tubes 60/160, 80/180 varies with operations of the system, as will be discussed below.

The plurality of first tubes 60 extend in the same direction and are disposed in a parallel and offset manner with respect to each other to extend from a first manifold 92 to a second manifold 192. The first tubes 60 are positioned with respect to each other such that the adjacent tubes within the first set of tubes establishes a space X therebetween along each tube between the first manifold 92 and the second manifold 192. Other aspects of the plurality of first tubes from each embodiment will be discussed in detail below.

The plurality of second tubes 80 all extend in the same direction and are disposed in a parallel and offset manner with respect to each other to extend from a third manifold 96 to a fourth manifold 196. The second tubes 80 are positioned with respect to each other such that the adjacent tubes within the second set of tubes establishes a space Y therebetween along each tube between the third manifold 96 and the fourth manifold 98. A central portion 81 (also referred to as the heat exchange portion) of each of the second tubes 80 are disposed within the space X between adjacent central portions 61 (heat exchange portions) of adjacent first tubes 60. Wherein "each" tube as used herein with respect to both the first set of tubes 60 and the second set of tubes 80 is specifically defined herein to mean all of the respective tubes with the possible exception of the tube(s) 60 and/or tube(s) 80 that is the most outboard of the plurality of tubes, and establishes an outer tube within the heat exchange assembly. One of ordinary skill in the art will understand that for the two tubes that establish the outer tube within the heat exchange assembly, there will be no tubes that extend adjacent to that tube on the outer side of that tube and therefore the central portion of the outer tubes do not extend within a space between adjacent tubes of the other set of tubes. The term "each" includes all tubes that extend between two tubes of the opposite sets of tubes, and to include the two tubes that establish the outer-most tube of the heating assembly, which are adjacent to the central portion of a tube from the other set of tubes.

The heat exchanger 10 may be aligned within a HVAC system or a cooling system. The heat exchanger 10 allows for two flows of fluid, a first flow simultaneously through the plurality of first tubes 60 and a second flow simultaneously though the plurality of second tubes 80. The heat exchanger 10 may be plumbed with respect to the HVAC or cooling system in various different scenarios, so that flow through both the first and second sets of tubes are each in the general direction D (FIG. 1), both in the general direction E (FIG. 1) or that a flow through the plurality of first tubes 60 is in the direction D and the flow through the plurality of second tubes is in the direction E. The heat exchanger 10 may be used with a forced air or fluid flow across the tubes and the fins 58 that are connected to the tubes or with other heat transfer methods as known in the art.

Figure 6A:
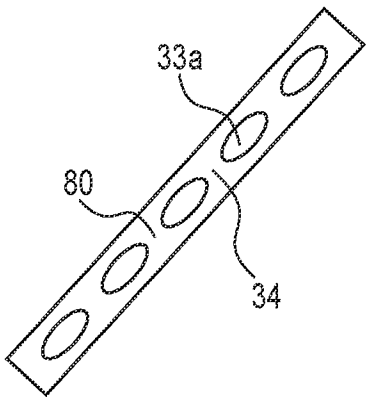
FIG. 6*a* is an end view of detail B with an end portion of the second tube with a plurality of spaced apart lumens (the plurality of separated lumens within the first tube would be the same).
Figure 6:
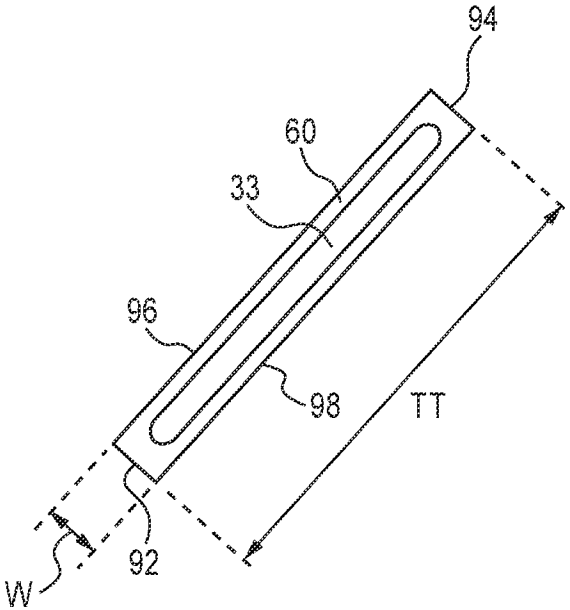
FIG. 6 is an end view of detail A with an end portion of the first tube with a single lumen (the single lumen within the second tube would be the same).

The tubes 60 and 80 may be formed with different geometries and different cross-sections. In some embodiments, the tubes are formed with outer walls that establish a single lumen 33, i.e. a refrigerant flow channel through which refrigerant flows therethrough, as shown in FIG. 6. In other embodiments, the tubes 60 and 80 may include a plurality of parallel lumens 33*a* (flow channels) (FIG. 6*a*, also representative of tubes within the heat exchanger) that are disposed therealong so that refrigerant flows in parallel and separated paths through the length of the tube 60 and 80, which maximizes a surface area of the tube within the combined lumens that is available to allow for heat to transfer from or to the fluid flowing within the tube within the heat exchange assembly. The adjacent parallel lumens are separated by a division wall 34 of the tube that extends along the length of the tube body to allow continuous separated flow within each lumen for the length of the tube 60, 80. As will be readily understood by one of skill in the art with a thorough review of the subject specification, the number of and cross-sectional areas of the lumens through the tubes may be optimized to maximize the available heat transfer but minimize flow resistance through the tubes. While the figures depict a single lumen 33 in tube 60 and a plurality of lumens 33*a* in tube 80, this is just for the sake of depicting both structures in the figures, and all of the tubes 60, 80 may each have a single lumen, all of the tubes may each have a plurality of lumens 33, or some tubes may have a single lumen 33 (e.g. possibly the tubes 60, 80 positioned toward the center of the manifold) while other tubes may have a plurality of lumens 33*a* (e.g. in this potential embodiment the tubes proximate the outside of the manifold).

The tubes 60, 80 are preferably made from metal, although other materials that have high thermal conductivity. The tubes may be constructed from a uniform material along the entire cross-section and length of the tube, while in other embodiments, the tube could be constructed from several layers, such as an inner layer of more flexible material (with a relatively high thermal conductivity) but that is flexible enough to be bent into the desired shape of the transition region 61*a*, 81 as discussed below without resulting in crimping or significantly blocking the lumens x, while another material provided outboard with a higher thermal conductivity and potentially with other benefits (weight, cost benefits over the inner flexible material). The tubes 60, 80 may be constructed by extrusion, or machining, or by bending planar pieces into shape to form the desired cross-sectional geometry and then bent in the geometry and shape along the length of the tubes.

The tubes 60 and 80 are each depicted in FIGS. 2-5, depicting the tubes next to each other with the respective central portions 61, 81 in parallel with each other, but with the planar end portions 61*x*, 81*x* extending in opposite directions.

The tubes 60 and 80 may each be approximately rectangular in cross-section, with right side surfaces 96, 106 (the right side surface being the right side, i.e. 3 o'clock position as one looks down the length of the tube 60, 80 toward the transition portion 61*a*, 81*a* with the top surface at the 12 o'clock position) and left side surfaces 98, 108 (the left side surface being the left side, i.e. 9 o'clock position as one looks down the length of the tube 60, 80 toward the transition portion 61*a*, 81*a* with the top surface at the 12 o'clock position) and top surfaces 92, 102 and bottom side surfaces 94, 104 (at the respective 12 o'clock and 6 o'clock position as one looks down the length of the tube 60, 80 toward the transition portion 61*a*, 81 *a*.

The term approximately rectangular is used herein to include exactly rectangular (with planar sides that are at right angles with respect to each other) as well as to include shapes that have left and right surfaces with projections facing in the left direction (9 o'clock) and right direction (3 o'clock) that are wider than the projections that face in the upper and lower directions including shapes where one, some, or all of the side surfaces may have some curvature along their width (with the remaining surfaces being planar), and the adjacent surfaces may transition from each other (such as the top to the left side surface, by way of example) with a curved transition instead of an edge, with other transitions formed with edges. In some embodiments, the central portions 61, 81 of each of the tubes are arranged when assembled within the heat exchanger 10 such that a first plane 3000 (FIG. 1) extends through each of the upper facing surfaces (projections) and a second plane 3001 that is parallel to the first plane extends through each of the downward facing surfaces (projections).

Figure 1:
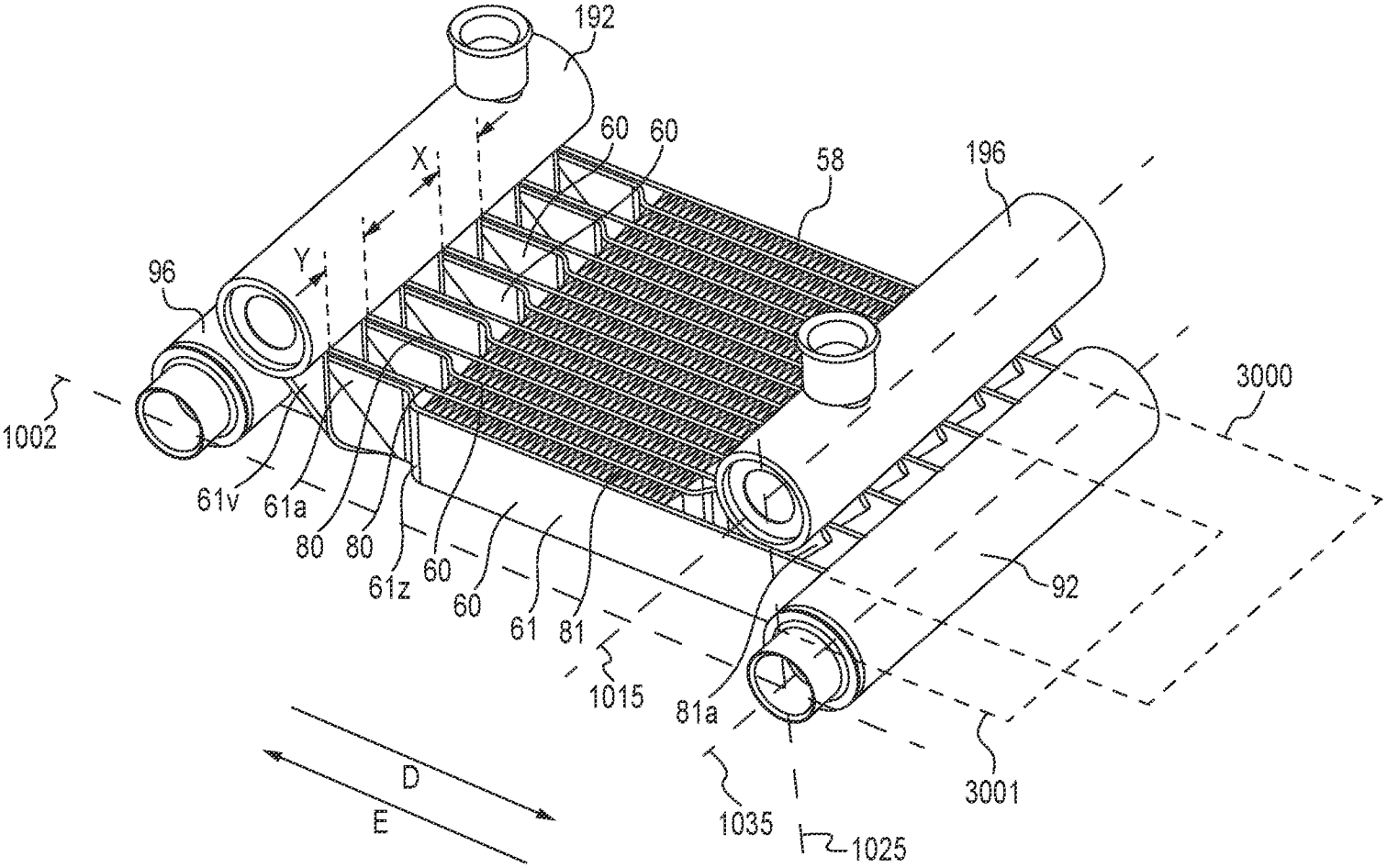
FIG. 1 is a perspective view of a heat exchanger that includes a dual flow of a fluid, such as a refrigerant or a heating fluid.
Figure 2:
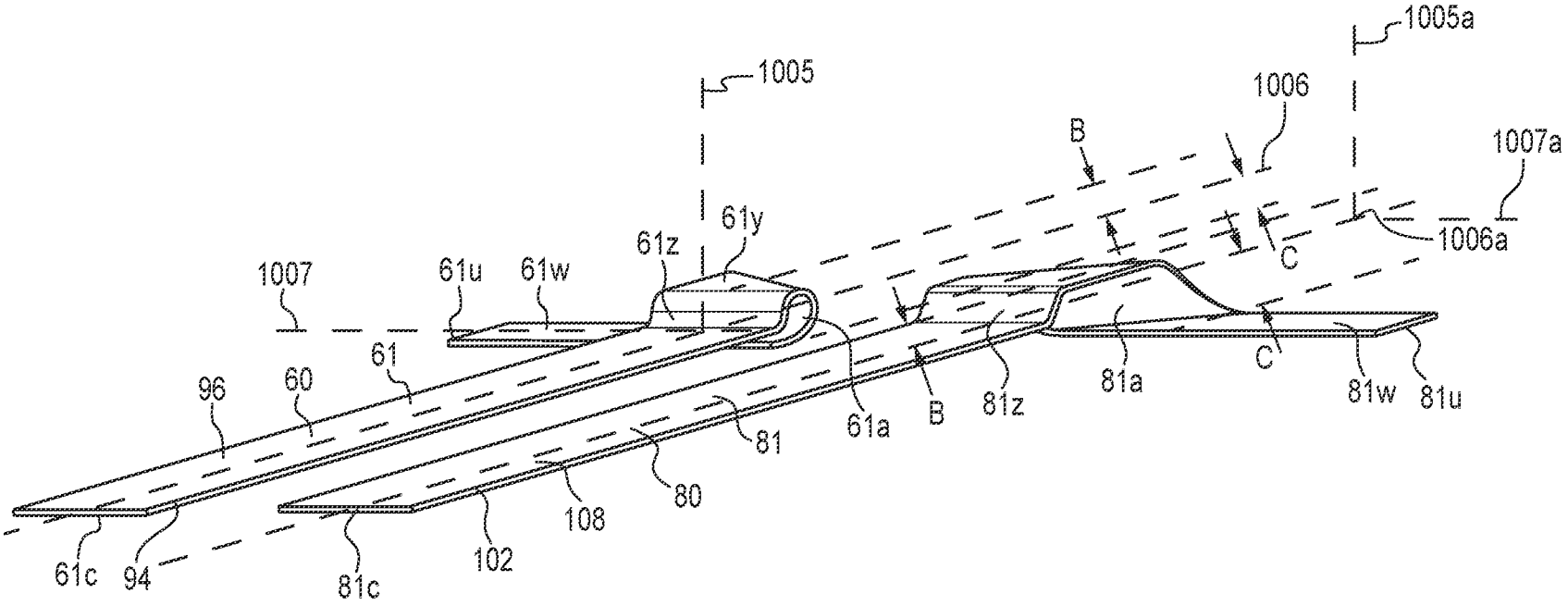
FIG. 2 is a perspective view of the first and second tubes with a right side of the first tube (60) pointed upward on the page and the left side of the second tube (80) pointed upward on the page.

The first and second plurality of tubes 60 and 80 may connect to opposite manifolds that assist with distributing the flow of refrigerant such that the first manifold reached by the refrigerant approaches the respective set of tubes allows the flow to separate to flow in parallel through each of the tubes until reaching the opposite manifold, which returns the refrigerant to a single flow to flow out of the manifold to the next portion of the refrigerant circuit. As best shown in FIG. 1, two manifolds (92, 96 are provided with centers that are in-line with a line 1002 through the center portion 61/81 of each of the plurality of tubes 60/80, and two other offset manifolds 192, 196 are disposed vertically above and in some embodiments horizontally offset from the two in-line manifolds. Specifically, the offset manifolds are positioned such that line 1025 that extends through a centerline 1035 of an inline manifold (e.g. 92, 96) and a centerline 1015 of an offset manifold (e.g. 192, 196) is perpendicular to, or at an acute angle to, the line 1002 through the two inline manifolds (92, 96), such that at least a portion of the two offset manifolds rests above the plurality of tubes, as understood with respect to the figures.

As depicted in FIG. 1, in some embodiments a plurality of fins 58 (or air centers) are provided that extend from the each of the first set of tubes 60 along a central portion 61 of each of the first set of tubes. In some variations, the plurality of fins 58 may extend to make contact with (and in some embodiments may be fixed to) the adjacent second set of tubes 80. In some other variations, a plurality of fins 58 are provided that extend from each of the second set of tubes 80 along a central portion 81 of each of the second set of tubes. In some variations, the plurality of fins 58 may make contact with the first set of tubes 60. In some embodiments, the plurality of fins 58 may be fixed to both adjacent first and second tubes 60, 80 and may be manufactured as a separate component that is fixed to the adjacent tubes, such as by brazing. The fins 58 may be in various shapes that maximize the available surface area for heat transfer from or to the fins 58 (resulting in heat transferring from or to the refrigerant flowing through the tubes) due to outside ambient air passing past the fins, either with one or more fans urging air to flow therepast, or without forced air flow. For example, the fins 58 may be a series of parallel plates that each extend approximately perpendicular to a line through each central portion of the tubes, or in other embodiments, the fins may be a plurality of "X" shaped fins (when viewed from above or below the central portions) with the tips of the X's contacting adjacent fins, or slightly spaced from contacting adjacent fins. The fins 58 that are adapted to be positioned between two adjacent tubes may be mechanically fixed to each other for ease of assembly and brazing.

The first and second sets of tubes 60, 80 each have a central portion 61, 81 and a transition portion 61*a*, 81*a* on a first end thereof which extends from the central portion 61, 81 to connect to the respective offset manifold at ends 61*d*, 81*d*. The opposite end of the tubes 60, 80 (i.e. the ends of the central portion 61, 81) has an end 61*c*, 81*c* that extends from the central portion 61, 81 with the same geometry and orientation as the central portion 61, 81, which connects to the respective inline manifold 202, 204. The bent portions 61, 81 are discussed in detail below.

Figure 3:
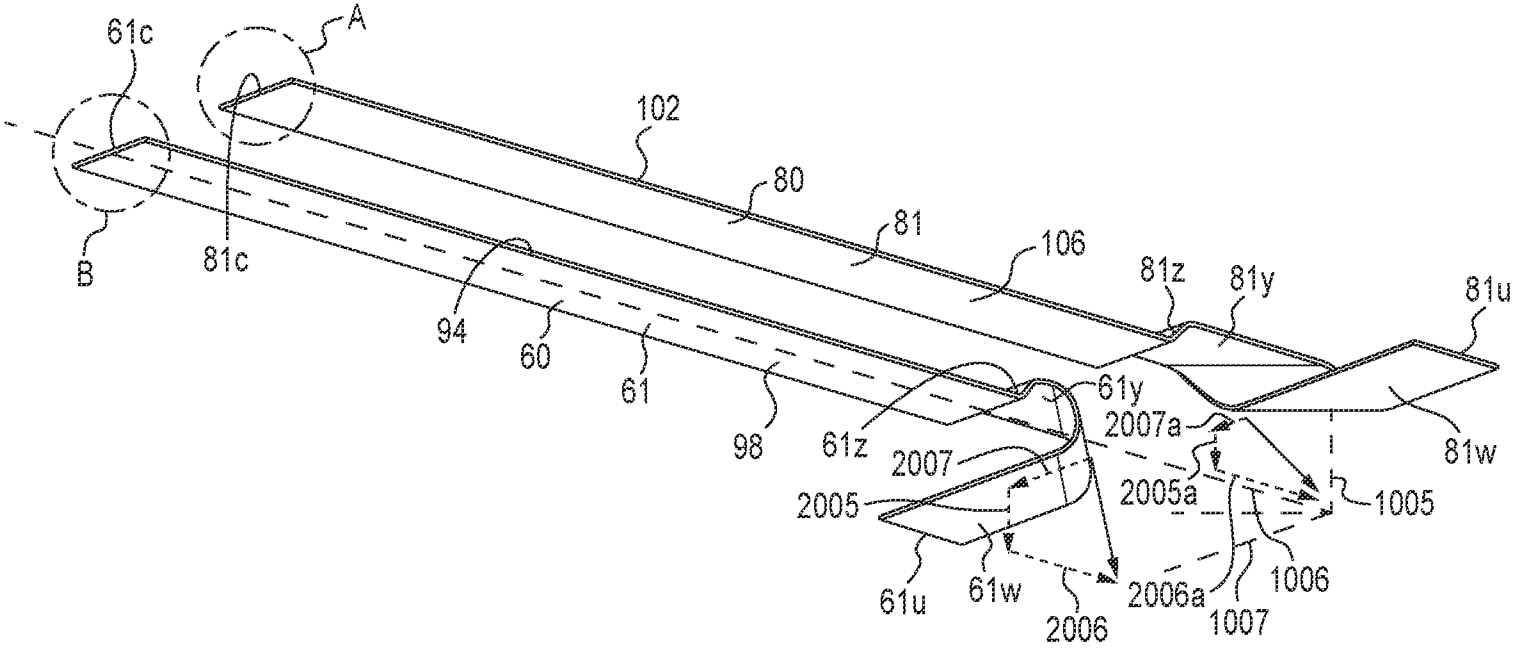
FIG. 3 another perspective view of the first and tubes with a left side of the first tube pointed downward on the page and the right side of the second tube pointed downward on the page.
Figure 4:
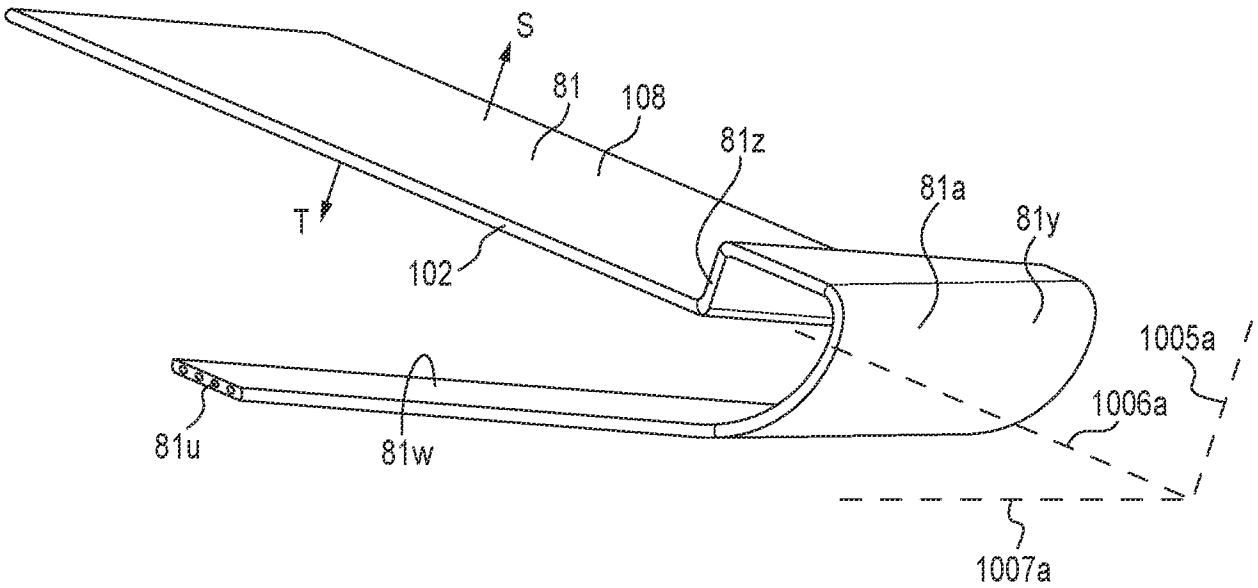
FIG. 4 is another perspective view of the second tube (the first tube is similar as understood with reference to FIGS. 2, 3, 5, and 7.
Figure 5:
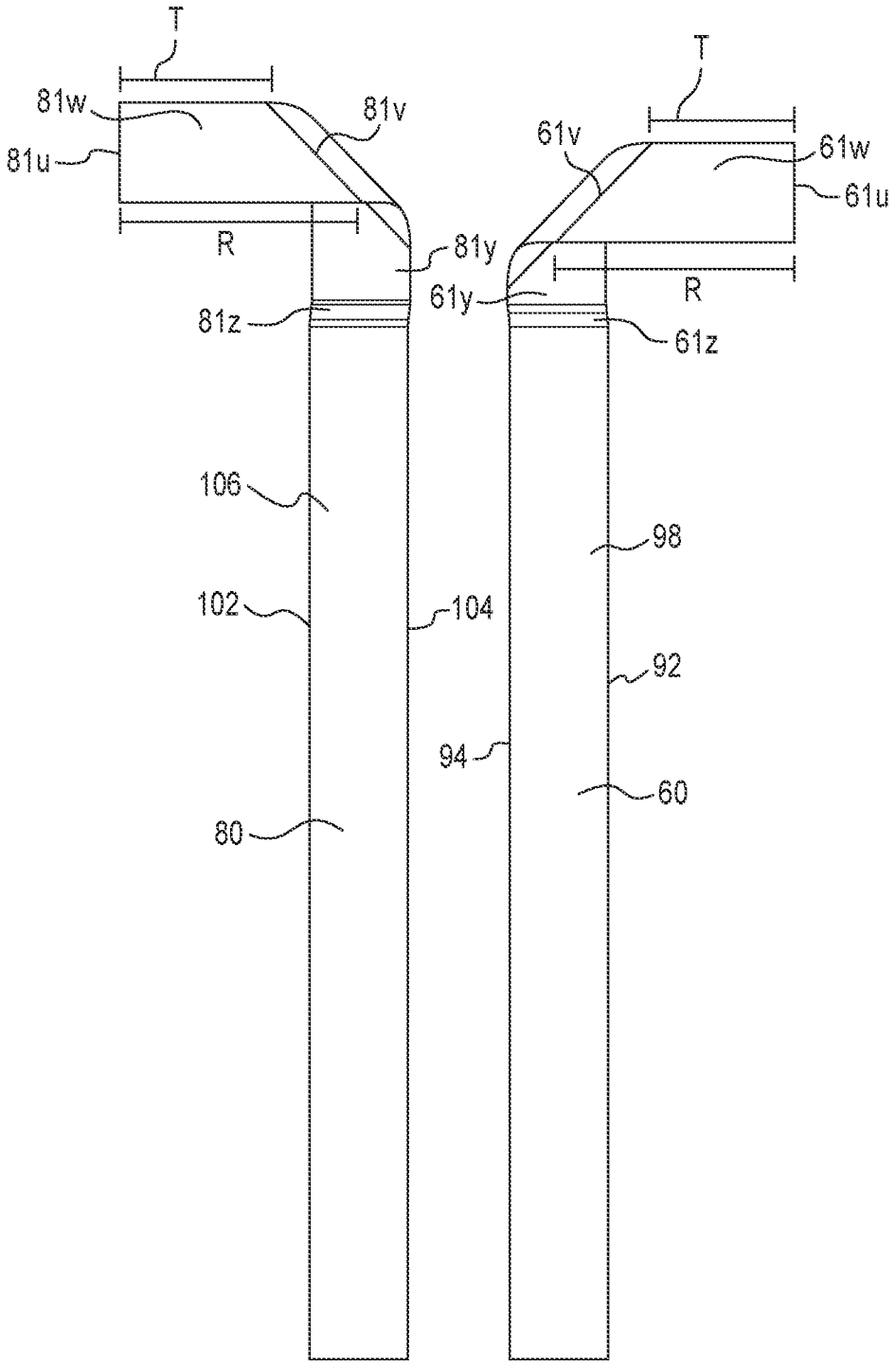
FIG. 5 is a planer side view of the left side surface of the first tube and the right side surface of the second tube.

In some embodiments, as shown in FIG. 4 a transition portion (which may be formed with bends, or curves or both features) 61*a*, 81*a* is oriented such that a portion of the transition portion 61*a*, 81 *a*, extends from the central portion 61, 81 and extends on both the right direction S and the left direction T from a line 1006 that extends through the central portion 61, 81 and is parallel the right and left side walls of each respective tube (e.g. walls 64, 62 for the first tubes and walls 84, 82 for the second tubes). Specifically as shown in FIGS. 2-5 of a portion of a tube 60 (tubes 80 may be the same in some embodiments, or exactly the opposite in other directions) includes a transition portion 61*a*, (81*a* for tube 80) that may initially include a first bend 61*z*, 81*z* that extends in the right direction (left direction for tube 80) so that the tube travels on the right side of the line 1006, and then a second portion that extends in the left direction such that the tube extends on the left side of the line 1006 (1006*a* for tube 80) (right direction for tube 80). The tube 80 is formed in the opposite manner, with the first bend extending in the left direction and then the second bend extending in the right direction. The first bend 61*z*, 81*z* is a jog region that allows the tube to be disposed through a plane that is parallel to and offset from a plane through line 1006 (1006*a* for tube 80, for the sake of brevity all recitations of line 1006 will refer to line 1006 for tube 60 and 1006*a* for tube 80 as depicted in the figures). In some embodiments, the transition portion 61*a*, 81*a* may include a bend that extends about the same distance from the plane in the maximum right direction B and in the maximum left direction B. The term about the same distance is defined herein to mean the exact same distance as well as distances that are within a range of plus or minus 20% of the total distance of the reference distance inclusive of all values within the range.

In some embodiments, the tip 61*c* (tube 80 may have the same feature) of the transition portion 61*a* (which connects to the respective offset manifold (192, 196) extends a maximum right or left distance C from the line 1006 with the bent portion 61*a* previously extending a maximum opposite left or right distance B (through the jog portion 61*z*, 81*z*) before reaching the tip 61*c*. In some embodiments, the maximum right and left distances B, C that the bent portion travels may be substantially the same distance on opposite sides of line 1006. Substantially the same distance is defined herein to mean the exact same distance as well as a range of plus or minus 20% of the total distance of the reference distance, inclusive of all values within the range.

The transition portion 61*a*, 81*a* also angles the tube 60, 80 such that it extends in a direction that the upper walls 66, 86 face to allow the tube to contact and flow into the offset manifold 192, 196, which is positioned above the upper wall 66, 86 of the tube 60, 80. In some embodiments, one or both of the jog 61*z*, 81*z* and the second extending portions may also include extend upwardly. Alternatively, the right and left bending portions 61*z*, 81*z* may be in series with the upward bending portion such that the upward bend occurs in a different section of the tube that bends in the left and right directions.

In some embodiments, the tube body initially transitions from the central portion 61*a*, 81*a* (heat exchange portion) to the angled portion 61*z*, 81*z*. The angled portion includes a first portion that extends in a direction that is perpendicular or almost perpendicular with the line 1006 that extends through the central portion in a direction that is faced by the right side surface 98 in tube 60, and in an opposite direction that is faced by the left side surface 106 in tube 80. In other words the angled portion 61*z*, 81*z* extends either parallel to a line 1005 that extends from the right side surface 98 of the tube 60 and is perpendicular to the line 1006 (or line 1005*a* that extends from a left side surface 106 of the tube 80, for the sake of brevity the line 1005 with respect to tube 60 will also include line 1005*a* as with respect to tube 80 when line 1005 is mentioned below), or extends almost perpendicular to the line 1006 (and the opposite left side surface 106 with respect to the tube 80). The term almost perpendicular is defined herein to include exactly perpendicular as well as a range of between 45 degrees less than perpendicular to 10 degrees greater than perpendicular to the line 1006, and in circumstances where it is not exactly perpendicular it includes a vector component that is parallel to line 1006. Almost perpendicular also is defined herein to include a portion that is not straight along its entire length but includes a best fit line through the portion that makes an angle that is within a range of 45 to 100 degrees from the reference line (i.e. line 1006 in this circumstance) including all angles within this range. In some specific embodiments the first portion of the angled portion may extend at 60 degrees, 65 degrees, 70 degrees, 75 degrees, 80 degrees, 85 degrees, 95 degrees with respect to line 1006 measured along a plane that lines 1005 and 1006 extend through, including values between these angles. The term almost parallel is defined consistently with the term almost perpendicular, but with the opposite difference from the line 1006 (i.e. between 45 and 10 degrees from parallel to the line 1005). In some embodiments, the angled portion 61*z*, 81*z* may additionally extend along a vector component that is parallel to direction 1007, which is perpendicular to both lines 1006 and 1005 and line 1007 extends through the top and bottom surfaces of each of tubes 60, 80. Line 1007 includes like 1007*a* that is with respect to tube 80, and all references of line 1007 below include reference to line 1007 with respect to tube 60 and line 1007*a* with respect to tube 80.

In some embodiments, angled portion 61*z*, 81*z* then bends to a second straight portion 61*y*, 81*y* that is parallel to or approximately parallel to the line 1006, but offset from the line 1006 by a jog of a length B. In other words, the jog is the length of the angled portion 61*z*, 81*z* when the angled portion is exactly perpendicular to the line 1006, and the length of the vector component in the direction perpendicular to line 1006 when the angled portion is almost perpendicular to the line 1006. The term approximately parallel is defined herein to include exactly parallel as well as an extension at an angle of 15 degrees or less from the reference line 1006. The term approximately parallel is also defined herein to include a portion that is not straight along its entire length but includes a best fit line through the portion that makes an angle with respect to the reference line that is within a range of 15 degrees from parallel in both directions away from parallel, including all angles less than 15 degrees on both sides of parallel within the range. As discussed elsewhere herein the various bends or transitions between different portions are typically not at geometric edges but rather with low radius bends to prevent crimping of the lumens 33 within the tube, and therefore the distance B, when exactly perpendicular or almost perpendicular, is measured with respect to a center of the tube in all circumstances.

The second straight portion 61*y*, 81*y* then moves on to a transition portion 61*x*, 81*x* from the second straight portion 61*y*, 81*y*. As depicted in FIG. 3, the transition portion 61*x*, 81*x* includes simultaneous bending of the tube in two different directions, specifically in a horizontal direction (vector component 2005, 2005*a*) (i.e. a direction parallel to line 1005) that faces the other of the right or left side surfaces of the tube (along the central portion) opposite the direction of the angled portion 61*z*, 81*z*, and extends in a direction (vector component 2007, 2007*a*) that is perpendicular to both the lines 1006 and 1005, i.e. in a direction that is parallel to the direction that the top surface 92, 102 of the tube faces, i.e. parallel to line 1007. The transition portion 61*x*, 81*x* is in some embodiments, a section that is continuously changing direction along its length so that the magnitude of one or both vector components that are parallel to lines 1005 and 1007 are changing at every instantaneous point along the length of the transition portion 61*x*, 81*x*. Along a portion of the transition portion 61*x*, 81*x* the instantaneous direction of the portion extends also with a vector component that is parallel to line 1006, specifically for a section of the transition portion 61*x*, 81*x* that directly extends from the second straight portion 61*y*, 81*y*. The vector component that is parallel to line 1006 may be constant or continuously or periodically changing. The transition portion 61*x*, 81*x* extends until the transition portion results in the tube extending in a direction that is parallel to a "vertical direction" i.e. parallel to a line that is parallel to line 1007, i.e. a line that extends perpendicularly from the top surface 92, 102 of the tube along the central portion 61*a*, 81*a* (i.e. where the direction of the tube has no vector components parallel to the lines 1006 and 1005).

In alternative embodiments, the transition portion 61*x*, 81*x* is periodically changing direction along its length so that the magnitude of one or both or all three of the vector components (in the directions parallel to lines 1005 and 1007 and 1006) at portions where the direction is continuously changing, the magnitude of at least one of the vector components in parallel to each of lines 1005, 1006, and 1007 is continuously changing, while for other portions of the transition portion the magnitude of the three vector components do not change along that region. In this embodiment, there may be one or more continuously changing portions that are separated from one or more portions where the vector components are not changing. In this embodiment, the transition portion 61*x*, 81*x* extends until the transition portion results in the tube extending in a planar direction (planar end portion) 61*w*, 81*w* that is parallel to a "vertical direction" i.e. parallel to a line that is parallel to line 1007, i.e. a line that extends perpendicularly from the top surface 92, 102 of the tube along the central portion 61*a*, 81*a* (i.e. where the direction of the tube has no vector components parallel to the lines 1006 and 1005).

In some embodiments, the planar end portion 61*w*, 81*w* has an interface 61*v*, 81*v* with the adjacent portion of the transition portion 61*x*, 81*x* where the instantaneous direction had at least vector components parallel to lines 1007 and 1005, and possibly 1006). In some of these embodiments, the interface 61*v*, 81*v* occurs proximate to the top and bottom 92, 94; 102, 104 surfaces of the tube at different (varying) linear distances from an end face 61*u*, 81*u* of the tube body, as depicted with distances R and T in FIG. 5.

In the above embodiments, the transition portion 61*a*, 81*a*, and the jog portion 61*z*, 81*z* is formed with a geometry that allows for a continuous and unblocked or significantly crimped inner lumen 33 or a plurality of lumens 33*a* within the tube so that refrigerant can flow therethrough, and without significantly more head loss (resistance to flow) than occurs through the central portion 61, 81 of the tube. One of ordinary skill in the art with a thorough review of the subject specification will understand based upon the geometry of the tube (outer geometries, wall thicknesses, size and shape of the lumen(s) how to design a tube and the maximum bending angles in order for the bends to avoid crimping or otherwise blocking the lumen(s) within the tube, such as to create an appropriately sized and shaped transition region 61*a*, 81*a* for the size of the heat exchanger, and will be able to design the tube dimensions and geometry with merely routine optimization. Based upon the geometry and size of the tube, and the size of the lumen(s) used within the tube, one of ordinary skill could calculate a "minimum bend radius" as that term is understood in the art—i.e. a geometry of bending in specific circumstances to avoid crimping or otherwise significantly blocking flow through the lumen(s), and would be able to construct the transition portion of the tube with a geometry to be above this minimum bend radius.

In other embodiments, the bend may include only a left bend or a right bend (as defined above) and may include, with one of the left or right bends, an upward bend. Those of skill in the art with a thorough review of this specification will understand that the terms "right, "left," "upward," and "downward" relate to those directions as they occur within a given coordinate system disposed with respect to heat exchange system 50, 150, and these directional terms do not limit the actual direction that the heat exchange system is disposed when in use or when being manufactured with respect to the typical directions upon the earth or with respect to the force of gravity. For example, the heat exchange system 50, 150 may be positioned in an orientation in use or when being assembled or manufactured, such that the surface of the tubes that is designated as the "upper" surface faces downward (directly or with a vector component toward the earth) or in a complete or partial sideward direction.

The term "about" is specifically defined herein to include a range that includes the reference value and plus or minus 5% of the reference value. The term "substantially the same" is satisfied when the width of the end surfaces of the holes are both within the above range.

While the preferred embodiments of the disclosed have been described, it should be understood that the invention is not so limited and modifications may be made without departing from the disclosure. The scope of the disclosure is defined by the appended claims, and all devices that come within the meaning of the claims, either literally or by equivalence, are intended to be embraced therein.

Several embodiments of the disclosure and be better understood with reference to the following numbered paragraphs:

Numbered Paragraph 1. A heat exchange tube (60, 80) for a heat exchanger (30), comprising a tube body (2) delimiting at least one coolant channel (33, 33*a*) for a coolant or a refrigerant, the tube body (60, 80) having an outer top surface (92, 102) and an outer bottom surface (94, 104) arranged opposite one another at a thickness (TT) of the tube body and having two outer side surfaces (96, 98; 106, 108) arranged opposite one another at a width (W) of the tube body (60, 80), the outer side surfaces connecting the outer top to the outer bottom surface, wherein the tube body has a heat exchange portion (61, 81) extending along a straight extension direction (1006) such that flow through the at least one coolant channel flows in the extension direction when flowing through the heat exchange portion, wherein the tube body has an outlet portion (61*w*, 81*w*) extending along a transverse axis (1007) that is perpendicular with respect to the extension axis, such that flow through the at least one coolant channel flows in a transverse direction along the transverse axis when flowing through the heat exchange portion, wherein the tube body has a transition portion (61*a*, 81*a*) connecting the heat exchange portion to the outlet portion, wherein the transition portion transitions simultaneously in the transverse direction and along an offset axis (1005), wherein the offset axis is perpendicular to each of the extension direction and the transverse direction, wherein the transition portion is formed such that flow through the at least one coolant channel within the transition portion flows in a changing direction along a length of at least part of the transition portion, wherein the changing direction has vector components along both the transverse axis and the offset axis along the length of the transition portion, wherein the outlet portion is arranged at a distance (C) from the heat exchange portion measured in the parallel to the offset axis, wherein an end of the heat exchange has jog region (61*z*, 81*z*) that comprises a bend along the offset axis and on an opposite side of the heat exchange portion of the tube body than the outlet portion, wherein flow through the at least one coolant channel in the jog region has vector components along both the extension axis and the offset axis, and wherein the jog region (13) portion joins with the transition portion.

Numbered Paragraph 2. The heat exchange tube of Numbered Paragraph 1, wherein the transition portion further transitions simultaneously in along the extension axis, such that flow through the at least one channel within the transition portion has changing direction that also has vector components along the extension axis.

Numbered Paragraph 3. The heat exchange tube according to ether of Numbered Paragraphs 1 or 2, wherein the extension direction is a straight line.

Numbered Paragraph 4. The heat exchange tube according to Numbered Paragraph 2, wherein flow through the at least one coolant channel within the changing direction continuously changes direction along the transition portion such that the relative vector components along the transverse axis, the offset axis, and the extension axis each vary along the transition portion.

Numbered Paragraph 5. The heat exchange tube according to any one of Numbered Paragraphs 1-4, wherein an interface between the transition portion and the angled portion is at a varying linear distance along each of the top and bottom surfaces of the tube body.

Numbered Paragraph 6. The heat exchange tube according any one of Numbered Paragraphs 1-5 wherein the distance (C) at which the outlet portion (9) is arranged opposite the heat exchange portion (7) is smaller than a minimum bending radius (R) of tube wall.

Numbered Paragraph 7. The heat exchange tube according to any one of Numbered Paragraphs 1-6, wherein the tube body (2) delimits numerous coolant channels (33*a*) arranged in a queue along the thickness (TT) of the tube, wherein directly adjacent coolant channels (33*a*) are separated by a division wall (34) extending along the thickness of the tube body.

Numbered Paragraph 8. The heat exchange tube according to any one of Numbered Paragraphs 1-7, wherein the tube body comprises a uniform metal material.

Numbered Paragraph 9. A heat exchanger (10), comprising:

a first manifold, a second manifold, a third manifold, and a fourth manifold; a plurality of first tubes each with a first end connected to the first manifold and a second end connected to the third manifold, each of the first tubes comprising a straight heat exchange portion and a curved transition portion;

a plurality of second tubes each with a first end connected to the second manifold and a second end connected to the fourth manifold, each of the second tubes comprising a straight heat exchange portion and a curved transition portion;

the plurality of first tubes all arranged in the same orientation and in parallel with each other and with a space between the straight heat exchange portions of adjacent first tubes the plurality of second tubes all arranged in the same orientation and in parallel with each other, each of the plurality of second tubes positioned within one of the spaces between adjacent first tubes with a possible exception of an one or more outermost second tubes of the plurality of second tubes, wherein the first and fourth manifolds are arranged proximate to each other and the second and third manifolds are arranged proximate to each other and further from the first and fourth manifolds;

wherein each of the plurality of first and second tubes further comprise:

an outer top surface (92, 102) and an outer bottom surface (94, 104) arranged opposite one another at a thickness (TT) of the tube body and having two outer side surfaces (96, 98; 106, 108) arranged opposite one another at a width (W) of the tube body (60, 80), the outer side surfaces connecting the outer top to the outer bottom surface, wherein the tube body has a heat exchange portion (61, 81) extending along a straight extension direction (1006) such that flow through the at least one coolant channel flows in the extension direction when flowing through the heat exchange portion, wherein the tube body has an outlet portion (61*w*, 81*w*) extending along a transverse axis (1007) that is perpendicular with respect to the extension axis, such that flow through the at least one coolant channel flows in a transverse direction along the transverse axis when flowing through the heat exchange portion, wherein the tube body has a transition portion (61*a*, 81*a*) connecting the heat exchange portion to the outlet portion, wherein the transition portion transitions simultaneously in the transverse direction and along an offset axis (1005), wherein the offset axis is perpendicular to each of the extension direction and the transverse direction, wherein the transition portion is formed such that flow through the at least one coolant channel within the transition portion flows in a changing direction along a length of at least part of the transition portion, wherein the changing direction has vector components along both the transverse axis and the offset axis along the length of the transition portion, wherein the outlet portion is arranged at a distance (C) from the heat exchange portion measured in the parallel to the offset axis, wherein an end of the heat exchange has jog region (61*z*, 81*z*) that comprises a bend along the offset axis and on an opposite side of the heat exchange portion of the tube body than the outlet portion, wherein flow through the at least one coolant channel in the jog region has vector components along both the extension axis and the offset axis, and wherein the jog region (13) portion joins with the transition portion.

Numbered Paragraph 10. The heat exchanger of Numbered Paragraph 9, wherein the jog region of each of the plurality of first tubes extends from the right side wall of the heat exchange portion of the respective first tube and the jog region of each of the plurality of second tubes extends from the left side wall of the heat exchange portion of the respective second tube.

Numbered Paragraph 11. The heat exchanger according to either one of Numbered Paragraphs 9 or 10, wherein the plurality of first tubes and the plurality of second tubes are arranged alternatingly along a stacking direction that corresponds to the offset axis of each of the plurality of first and second tubes.

Numbered Paragraph 12. The heat exchanger according to any ones of Numbered Paragraphs 9-11, wherein in a view along the stacking direction, the heat exchange portions (7) of the plurality of first tubes (1) completely overlap the heat exchange portions of the plurality of second tubes (31), wherein the transition portion and the outlet portion of each of the plurality of first tubes and the second tubes extend above the top surface of the adjacent other tube of the first or second tubes.

Numbered Paragraph 13. The heat exchanger according to any one of Numbered Paragraphs 9-12, further comprising heat transfer fins between adjacent first tubes and second tubes.

The invention claimed is:

1. A heat exchange tube for a heat exchanger, comprising a tube body delimiting at least one coolant channel for a coolant or a refrigerant, the tube body having an outer top surface and an outer bottom surface arranged opposite one another at a thickness of the tube body and having two outer side surfaces arranged opposite one another at a width of the tube body, the outer side surfaces connecting the outer top to the outer bottom surface, wherein the tube body has a heat exchange portion extending along an extension axis that is along a straight extension direction such that flow through the at least one coolant channel flows in the extension direction when flowing through the heat exchange portion, wherein the tube body has an outlet portion extending along a transverse axis that is perpendicular with respect to the extension axis, such that flow through the at least one coolant channel flows in a transverse direction along the transverse axis when flowing through the outlet portion, wherein the tube body has a transition portion connecting the heat exchange portion to the outlet portion, wherein the transition portion transitions simultaneously in the transverse direction and along an offset axis, wherein the offset axis is perpendicular to each of the extension direction and the transverse direction, wherein the transition portion is formed such that flow through the at least one coolant channel within the transition portion flows in a changing direction along a length of at least part of the transition portion, wherein the changing direction has vector components along both the transverse axis and the offset axis along the length of the transition portion, wherein the outlet portion is arranged at a distance from the heat exchange portion measured in parallel to the offset axis, wherein an end of the heat exchange portion has jog region that comprises a bend along the offset axis and on an opposite side of the heat exchange portion of the tube body than the outlet portion, wherein flow through the at least one coolant channel in the jog region has vector components along both the extension axis and the offset axis, and wherein the jog region portion joins with the transition portion.

2. The heat exchange tube of claim 1, wherein the transition portion further transitions simultaneously in along the extension axis, such that flow through the at least one channel within the transition portion has changing direction that also has vector components along the extension axis.

3. The heat exchange tube according to claim 1, wherein the extension direction is a straight line.

4. The heat exchange tube according to claim 2, wherein flow through the at least one coolant channel within the changing direction continuously changes direction along the transition portion such that the relative vector components along the transverse axis, the offset axis, and the extension axis each vary along the transition portion.

5. The heat exchange tube according to claim 1, wherein an interface between the transition portion and the angled portion is at a varying linear distance along each of the top and bottom surfaces of the tube body.

6. The heat exchange tube according to claim 1 wherein the distance at which the outlet portion is arranged opposite the heat exchange portion is smaller than a minimum bending radius of tube wall.

7. The heat exchange tube according to claim 1, wherein the tube body delimits numerous coolant channels arranged in a queue along the thickness of the tube, wherein directly adjacent coolant channels are separated by a division wall extending along the thickness of the tube body.

8. The heat exchange tube according to claim 1, wherein the tube body comprises a uniform metal material.

9. A heat exchanger, comprising:

a first manifold, a second manifold, a third manifold, and a fourth manifold;

a plurality of first tubes each with a first end connected to the first manifold and a second end connected to the third manifold, each of the first tubes comprising a straight heat exchange portion and a curved transition portion;

a plurality of second tubes each with a first end connected to the second manifold and a second end connected to the fourth manifold, each of the second tubes comprising a straight heat exchange portion and a curved transition portion;

the plurality of first tubes all arranged in the same orientation and in parallel with each other and with a space between the straight heat exchange portions of adjacent first tubes the plurality of second tubes all arranged in the same orientation and in parallel with each other, each of the plurality of second tubes positioned within one of the spaces between adjacent first tubes with a possible exception of an one or more outermost second tubes of the plurality of second tubes, wherein the first and fourth manifolds are arranged proximate to each other and the second and third manifolds are arranged proximate to each other and further from the first and fourth manifolds;

wherein each of the plurality of first and second tubes further comprise:

an outer top surface and an outer bottom surface arranged opposite one another at a thickness of the tube body and having two outer side surfaces arranged opposite one another at a width of the tube body, the outer side surfaces connecting the outer top to the outer bottom surface, wherein the tube body has a heat exchange portion extending along an extension axis that is along a straight extension direction such that flow through the at least one coolant channel flows in the extension direction when flowing through the heat exchange portion, wherein the tube body has an outlet portion extending along a transverse axis that is perpendicular with respect to the extension axis, such that flow through the at least one coolant channel flows in a transverse direction along the transverse axis when flowing through the outlet portion, wherein the tube body has a transition portion connecting the heat exchange portion to the outlet portion, wherein the transition portion transitions simultaneously in the transverse direction and along an offset axis, wherein the offset axis is perpendicular to each of the extension direction and the transverse direction, wherein the transition portion is formed such that flow through the at least one coolant channel within the transition portion flows in a changing direction along a length of at least part of the transition portion, wherein the changing direction has vector components along both the transverse axis and the offset axis along the length of the transition portion, wherein the outlet portion is arranged at a distance from the heat exchange portion measured in the parallel to the offset axis, wherein an end of the heat exchange portion has jog region that comprises a bend along the offset axis and on an opposite side of the heat exchange portion of the tube body than the outlet portion, wherein flow through the at least one coolant channel in the jog region has vector components along both the extension axis and the offset axis, and wherein the jog region portion joins with the transition portion.

10. The heat exchanger of claim 9, wherein the jog region of each of the plurality of first tubes extends from the right side wall of the heat exchange portion of the respective first tube and the jog region of each of the plurality of second tubes extends from the left side wall of the heat exchange portion of the respective second tube.

11. The heat exchanger according to claim 9, wherein the plurality of first tubes and the plurality of second tubes are arranged alternatingly along a stacking direction that corresponds to the offset axis of each of the plurality of first and second tubes.

12. The heat exchanger according to claim 9, wherein in a view along the stacking direction, the heat exchange portions of the plurality of first tubes completely overlap the heat exchange portions of the plurality of second tubes, wherein the transition portion and the outlet portion of each of the plurality of first tubes and the second tubes extend above the top surface of the adjacent other tube of the first or second tubes.

13. The heat exchanger according to claim 9, further comprising heat transfer fins between adjacent first tubes and second tubes.

* * * * *